United States Patent [19]

Davis

[11] 4,019,435

[45] Apr. 26, 1977

[54] SHEET INVERTING

[75] Inventor: William A. Davis, Wickliffe, Ohio

[73] Assignee: Addressograph Multigraph Corporation, Cleveland, Ohio

[22] Filed: Aug. 21, 1975

[21] Appl. No.: 606,660

[52] U.S. Cl. ..... 101/232; 101/242; 101/420; 271/65; 271/186; 271/225; 198/382

[51] Int. Cl.[2] ..... B41F 21/00

[58] Field of Search ..... 198/282–285; 101/232, 242, 416 R, 420; 271/225, 184, 186, 65, 245

[56] References Cited

UNITED STATES PATENTS

| | | | |
|---|---|---|---|
| 1,709,006 | 4/1929 | Broadmeyer | 271/225 |
| 1,883,471 | 10/1932 | Barrett | 271/245 |
| 2,266,587 | 12/1941 | Carlson | 271/225 |
| 2,665,633 | 1/1954 | Schubert | 271/225 |
| 2,723,119 | 11/1955 | Engebretson et al. | 271/225 |
| 3,062,532 | 11/1962 | Galatha | 271/225 |
| 3,190,644 | 6/1965 | Schwebel | 271/245 |
| 3,642,274 | 2/1972 | Herrington et al. | 101/420 |
| 3,700,231 | 10/1972 | Aasen et al. | 271/65 |
| 3,856,295 | 12/1974 | Looney | 198/284 |

*Primary Examiner*—Edgar S. Burr
*Assistant Examiner*—William Pieprz
*Attorney, Agent, or Firm*—Russell L. Root

[57] ABSTRACT

An improved paper handling system includes a pair of work units which sequentially work on opposite sides of a sheet with the same edge of the sheet leading. An inverter between the two work units is effective to invert the sheet in such a manner that the edge of the sheet which leads during passage of the sheet through the first work unit will also lead as the sheet passes through the second work unit. A sheet which has been worked on, first side up, by the first work unit will also lead as the sheet passes through the second work unit. A sheet which has been worked on, first side up, by the first work unit with a head edge of the sheet leading is moved by a first conveyor along a first path into engagement with a stop member which engages the head edge of the sheet to arrest it at a first readiness position. A pusher then engages a side edge of the sheet and pushes it sidewardly. The turnover mechanism is effective to move the sheet sidewardly along a generally U-shaped path into engagement with a stop to register the sheet at a second readiness position relative to the second work unit. A second conveyor is then effective to move the sheet into the second work unit with the head edge of the sheet leading and a second side of the sheet facing upwardly.

23 Claims, 6 Drawing Figures

SHEET INVERTING

BACKGROUND OF THE INVENTION

This invention relates generally to a method and apparatus for sequentially working on a sheet with first one side up and then the other using a pair of work units while the same edge of the sheet leads as the sheet passes through each of the work units. The particular application for which the invention is intended, involves printing equipment for printing on both sides of a sheet, and the following description is expressed primarily in terms of that environment. It will however be readily apparent that sheet handling equipment of this nature will be equally applicable in other situations.

There are known printing systems which are effective to simultaneously print on opposite sides of a sheet. These known printing systems are rather complicated in their mode of operation. Somewhat simpler printing systems have been used which are effective to print on only one side of a sheet. Still other printing systems have utilized a pair of printing units to sequentially print on opposite sides of a sheet.

Some of the known printing units which sequentially print on opposite sides of a sheet have utilized inverters to invert the sheet between the printing units. When these known inverters are utilized to invert a sheet, a first edge of the sheet leads as it passes through the first printing unit and the second edge of the sheet leads as it passes through the second printing unit. Some of these known inverters have utilized cylinders which have relatively complicated gripper arrangements to effect a turning over or inverting of the sheet.

SUMMARY OF THE PRESENT INVENTION

The present invention relates to a printing apparatus and method which inverts a sheet between a pair of printing units in such a manner that the same edge of the sheet leads as it passes through the two printing units. After a sheet has been printed on an upwardly facing side with a head edge leading by the first printing unit, a first conveyor between the printing units receives the sheet with the head edge of the sheet leading. When the sheet has been moved by the first conveyor to a first readiness position at the entrance of a turnover mechanism, the head edge of the sheet engages a stop. A pusher then engages a side edge of the sheet and moves the sheet into the turnover mechanism with the opposite side edge of the sheet leading.

The turnover mechanism moves the sheet along a generally U-shaped path from an orientation in which the side of the sheet printed on by the first printing unit faces upwardly to an orientation in which the side of the sheet printed on by the first printing unit faces downwardly. At the end of this generally U-shaped path, the sheet enters a second readiness position, and its leading side edge engages stops to register the sheet relative to the second printing unit. A second conveyor is then effective to move the sheet into the second printing unit with the head edge of the sheet leading and the unprinted or blank side of the sheet facing upwardly.

Accordingly, it is an object of this invention to provide a new and improved system which acts on sheets moving in a predetermined direction and which inverts a sheet from a first orientation in which a first side of the sheet faces in one direction to a second orientation in which the opposite side of the sheet faces in the one direction, and continues to move the sheet in the same general direction with the same edge of the sheet leading as was leading initially.

It is also an object of this invention to provide a new and improved printing system which inverts a sheet from a first orientation in which a printed side of the sheet faces in one direction to a second orientation in which the opposite side of the sheet faces in the one direction, and moves the sheet through a second printing unit with the same edge of the sheet leading as was leading as the sheet passed through the first printing unit.

Another object of this invention is to provide a new and improved apparatus to sequentially print on opposite sides of a sheet with the same edge leading and wherein the apparatus includes an inverter assembly between first and second printing units to change the orientation of the sheet from an orientation in which a first or printed side of the sheet faces in one direction to an orientation in which a second or blank side of the sheet faces in the one direction by moving the sheet along a path which extends transversely to the direction of movement of the sheet through the printing units.

Another object of this invention is to provide a new and improved apparatus for printing on opposite sides of a sheet with the same edge of the sheet leading and wherein a sheet printed on one side by a first printing unit is moved by an inverter along a generally U-shaped path to a conveyor which moves the sheet to a second printing unit with the same edge leading as was leading as the sheet passed through a first printing unit.

Another object of the invention is to provide a new and improved method of sequentially working on opposite sides of a sheet and wherein the method includes the steps of working on a first side of the sheet in a first work unit with a first edge of the sheet leading, inverting the sheet, and working on the second side of the sheet with a second work unit as the sheet moves through the second work unit with the first edge of the sheet leading.

BRIEF DESCRIPTION OF THE DRAWINGS

The foregoing and other objects and features of the present invention will become more apparent of a consideration of the following description taken in connection with the accompanying drawings wherein.

DESCRIPTION OF THE INVENTION

General Description

Figure 1:
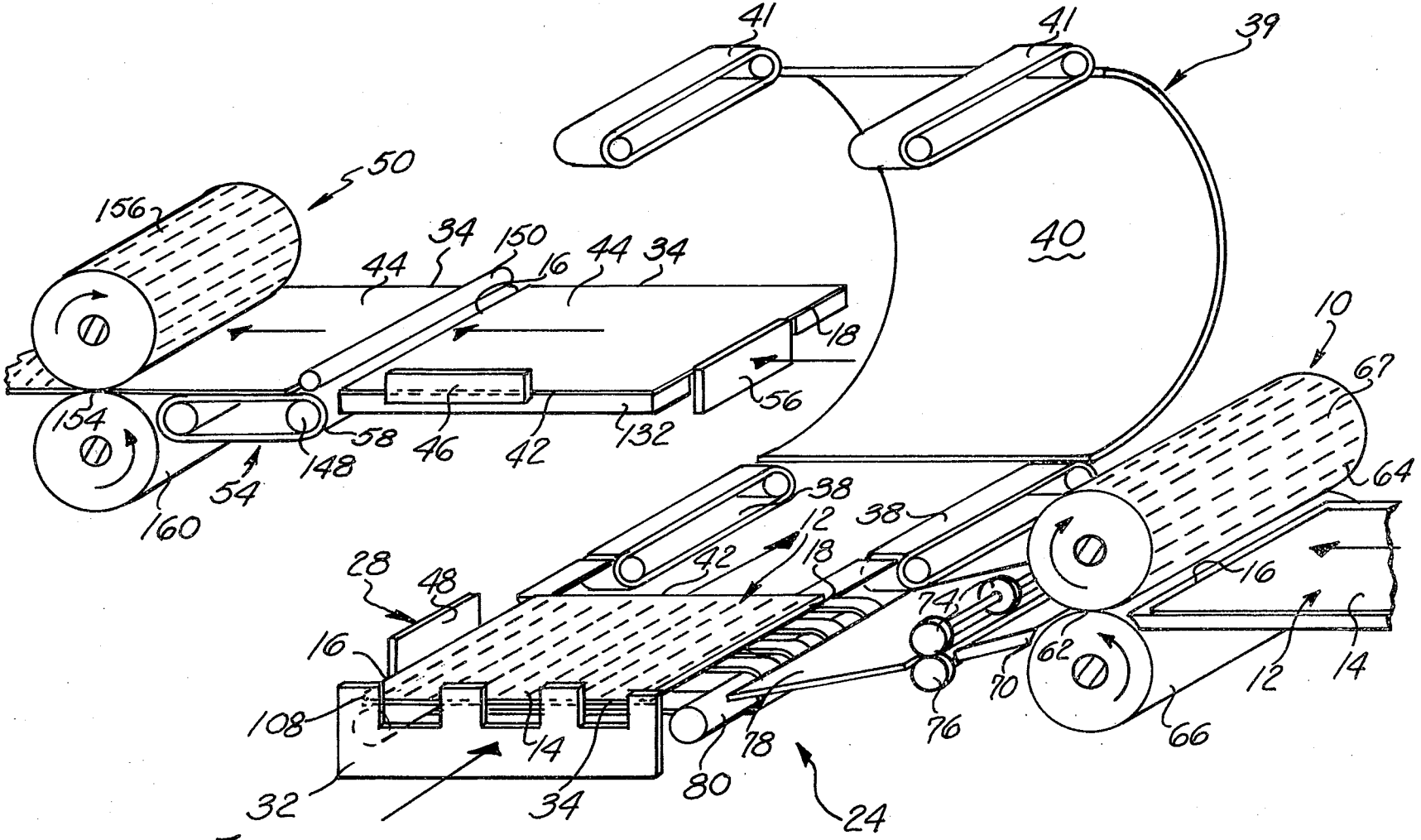
FIG. 1 is a schematic illustration of a printing system constructed and operated in accordance with the present invention and illustrating the relationship between a pair of printing units and an inverter.

Referring to the schematic showing in FIG. 1, a sheet printing system 8 constructed in accordance with the present invention is illustrated schematically in FIG. 1 and includes a first printing unit 10. The printing unit 10 prints on an upwardly facing first major side surface 14 of a sheet 12 as it passes through the first printing unit with the head edge 16 of the sheet leading and a foot edge 18 of the sheet trailing. As the sheet 12 moves out of the first printing unit 10, the sheet moves through pull out rolls 74, 76 and along guide means 70, 78 onto a conveyor which constitutes the initial station of an inverter 24.

As the sheet 12 enters the inverter 24, the leading head edge 16 of the sheet engages a stop 28 which stops the sheet in a predetermined position relative to a turnover mechanism 39. A pusher member 32 then engages a first side edge 34 of the sheet 12 and pushes it into engagement with lower conveyor belts 38 of the turnover mechanism. The conveyor belts 38 are effective to move the sheet along the lower leg of a generally U-shaped path with a second side edge 42 of the sheet 12 leading. An arcuate surface 40 guides movement of the sheet along the curved portion of the U-shaped path. Upper turnover conveyor belts 41 then move the sheet along the upper leg of the U-shaped inverter path.

As the sheet 12 moves through the turnover mechanism 39, the orientation of the sheet is changed from an orientation in which the printed major side surface 14 faces upwardly to an orientation in which a blank opposite major side surface 44 faces upwardly. When the sheet 12 has moved to a position substantially over the position in which it entered the inverter 24, the leading side edge 42 of the sheet engages a stop 46 which interrupts movement of the sheet at a second readiness position on a platform 132. Engagement of the sheet with the stop 46 registers the sheet relative to a second printing unit 50.

The sheet 12 is then started to the second printing unit 50 by a pusher member 56 which pushes against the trailing foot edge 18 of the sheet 12 to push the sheet into a nip between a roller 150 and conveyor belts 58. The conveyor belts 58 feed the sheet into the second printing unit 50 with the head edge 16 of the sheet leading. The printing unit 50 is then effective to print on the blank upwardly facing major side 44 of the sheet as the sheet passes through the printing unit. It should be noted that the opposite sides 14 and 44 of the sheet were sequentially printed on by the two printing units 10 and 50 with the same edge of the sheet leading, that is the head edge 16.

DESCRIPTION OF ONE SPECIFIC PREFERRED EMBODIMENT

As the sheet 12 passes through a printing nip 62 formed in the first printing unit 10 between a plate or master cylinder 64 and an impression cylinder 66, the upwardly facing major side surface 14 of the sheet 12 is printed on by a master 67. As the sheet 12 exits from the printing nip 62 with the head edge 16 leading, the sheet moves onto a guide surface 70 (FIG. 2) and is directed into a feed nip 72 formed between a pair of feed rollers 74 and 76. The feed rollers 74 and 76 feed the sheet along a support surface 78 downwardly onto a belt conveyor 80 forming the input stage of the inverter 24.

Figure 2:
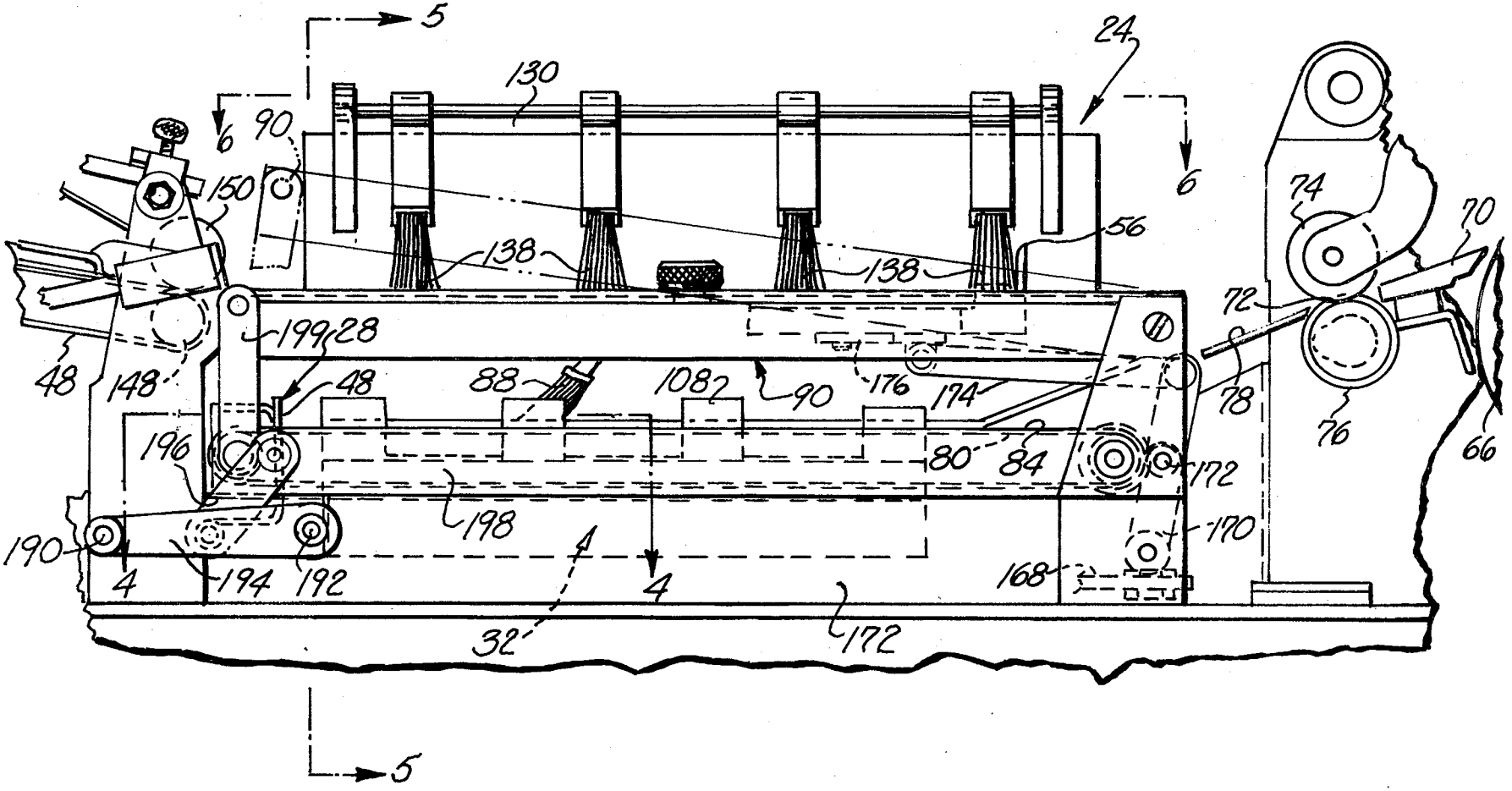
FIG. 2 is an enlarged elevational side view of a sheet inverter and conveyors constructed in accordance with the present invention.

The belt conveyor 80 has a horizontal upper run 84 which engages the downwardly facing blank side 44 of the sheet and moves the sheet toward the left (as viewed in FIG. 2). At the end of the conveyor 80, the leading head edge 16 of the sheet moves into engagement with the face surface 48 of the stop 28. The sheet is held from bouncing back away from the vertical face surface 48 on the stop 28 by one or more brushes 88 (FIGS. 2 and 5) which extend forwardly and downwardly from an upper level platform 90 of the inverter assembly 24. The brushes 88 slope toward the stop 28 so that the bristles of the brushes engage the printed upwardly facing surface 14 of the sheet 12 to hold the sheet against rebounding.

Figure 3:
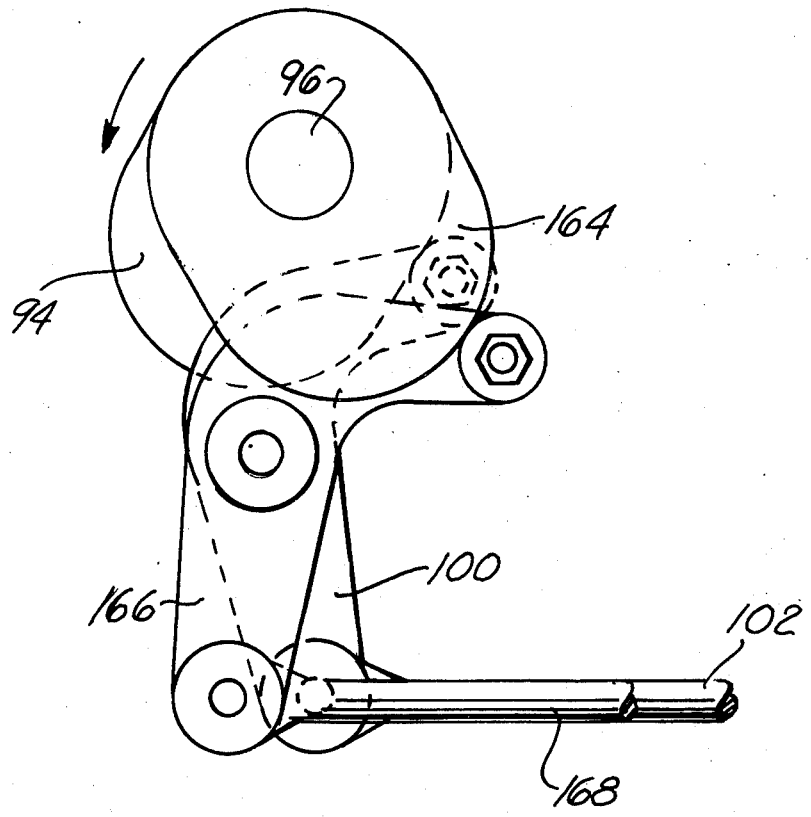
FIG. 3 is a fragmentary elevational view of cams which activate pusher linkages in the inverter.

Once the sheet 12 has moved into engagement with the stop 28, the pusher 32 is actuated to initiate movement of the sheet onto the parallel lower conveyor belts 38 of the turnover mechanism 39. The pusher member 32 has a vertical face surface which engages the side edge 34 of the sheet 12 as the pusher member is moved along a horizontal path extending perpendicular to the longitudinal central axis of the conveyor 80. This movement of the pusher member 32 is effected by a cam 94 (FIG. 3). The cam 94 is mounted on a horizontal shaft 96 which is rotated under the influence of the drive for the two printing units 10 and 50. Therefore, the cam 94 rotates in a timed relationship with the movement of sheets through the printing units. Preferably the shaft 96 makes one revolution for each rotation of the printing cylinders.

When the leading head edge 16 of the sheet 12 has moved into engagement with the stop 28, the cam 94 effects movement of a cam follower lever 100 to cause a horizontal link 102 to move to the left. This link is connected with a bell crank lever 104. (See FIG. 4.) The bell crank lever 104 is pivotally mounted at 106 for movement about a vertical axis. As the link 102 is moved to the left, the bell crank 104 is pivoted in a counterclockwise direction (as viewed in FIG. 4), and the pusher member 32 is moved along a horizontal path extending perpendicular to a horizontal longitudinal edge 107 of the conveyor belt 80. It should be noted that the stroke of the crank actuator rod 102 is relatively short so that the pusher 32 is moved from an initial position shown in solid lines in FIG. 4 to the position shown in dash lines in FIG. 4 in which an upwardly projecting body section 108 of the pusher member 32 is disposed adjacent to a longitudinally extending side edge 107 of the conveyor belt 80. A spring 105 serves to restore the pusher to home position and maintains the follower 100 in contact with its cam 94.

Figure 5:
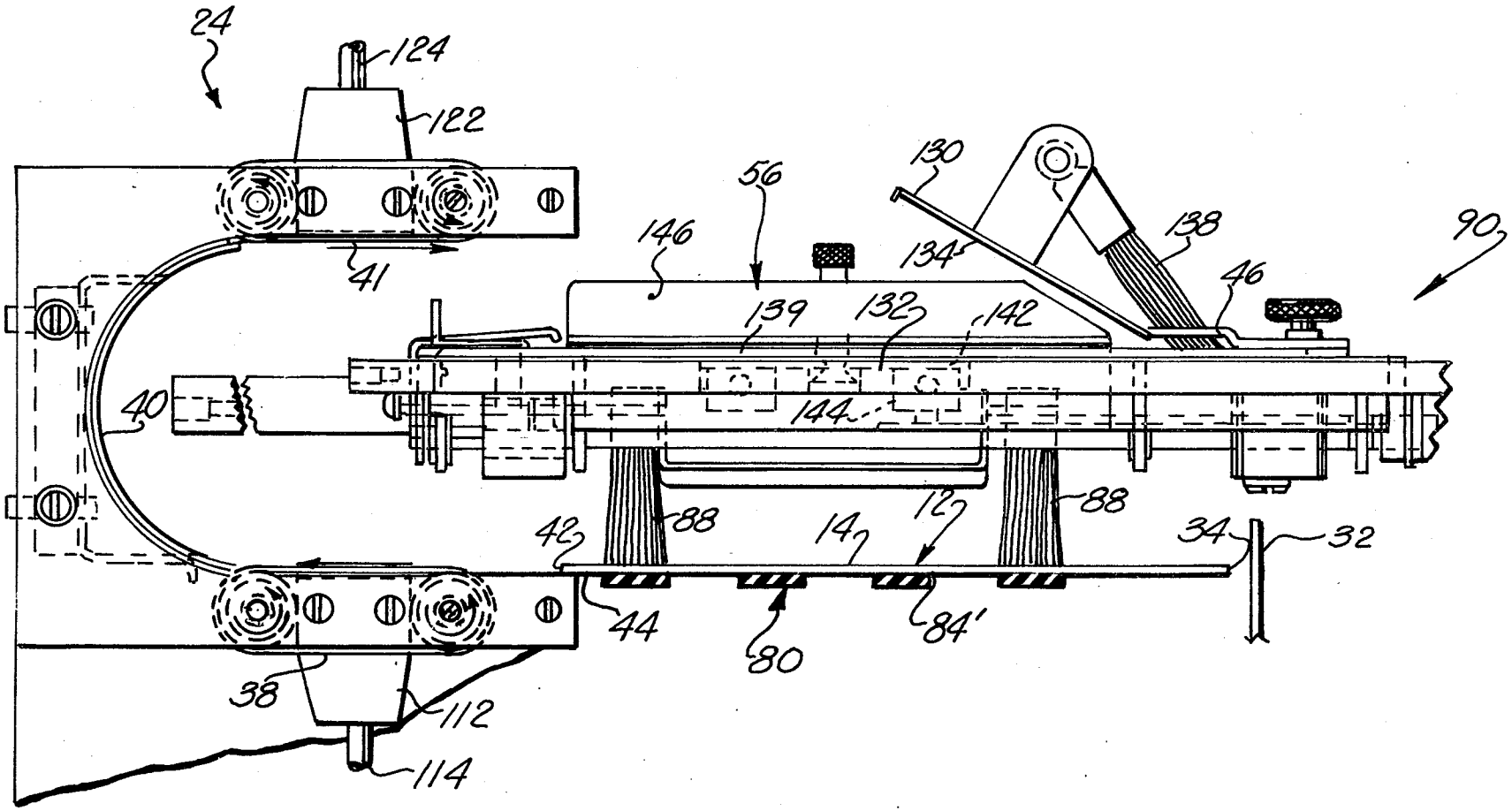
FIG. 5 is a sectional elevation taken generally on line 5—5 of FIG. 2.

As the sheet moves into the lower portion of the turnover mechanism 39, the leading side edge 42 of the sheet moves onto the continuously driven feed belts 38 (FIG. 5). The horizontal blank lower major side 44 of the sheet is urged downwardly into engagement with the feed belts 38 by suction applied to the lower side surface 44 of the sheet by a vacuum box 112 which is connected with a source of low pressure through a conduit 114. The upper run of the feed belt 38 is driven toward the left (as viewed in FIG. 5) to move the leading side edge 42 of the sheet along the horizontal lower leg of a generally U-shaped path along which the sheet travels in moving through the turnover mechanism 39.

As the sheet 12 continues to move through the turnover mechanism, the leading side edge 42 of the sheet moves along a semi-circular guide surface 40. The leading edge 42 of the sheet then moves into engagement with the upper feed belts 41. The now upwardly facing major blank side surface 44 of the sheet is drawn into engagement with the belts 41 under the influence of suction applied against the side surface 44 of the sheet by a second vacuum box 122 which is connected with a source of low pressure by a conduit 124.

The lower runs of the continuously driven feed belts 41 are effective to move the sheet toward the right (as viewed in FIG. 5) along the upper leg of the generally U-shaped inverter path. At this time the side edge 42 of the sheet is leading and the blank major side surface 44 of the sheet is facing upwardly. In moving from the conveyor belts 38 to the conveyor belts 41, the sheet is moved along a path which turns back on itself so that the blank major side 44 of the sheet which was facing downwardly when the sheet initially engaged the belts 38, is facing upwardly when the sheet moves into engagement with the belts 41. It should be noted that the width of the sheet, that is, the distance between the two side edges 34 and 42 of the sheet, is such that the leading edge 42 of the sheet moves into engagement with the conveyor belts 41 before the trailing edge 34 of the sheet moves out of engagement with the conveyor belts 38. Therefore, the sheet is continuously maintained in engagement with either the conveyor belts 38 or the conveyor belts 41 as the sheet moves along the U-shaped path through the inverter unit 24.

As the leading side edge 42 of the sheet moves rightwardly (as viewed in FIG. 5) away from the belts 41, it gradually droops down onto a support tray 132, and it also moves toward a sloping deflector plate 130 which is effective to insure deflection of the sheet downwardly onto the support tray. Thus, as the sheet leaves the conveyor belts 41, it moves toward the right (as viewed in FIG. 5) and the lead edge 42 is driven against the stop member 46 by the action of the conveyor belts 41. A plurality of brushes 138 (FIGS. 5 and 6) extend through openings in the deflector 130 into engagement with the upper side 44 of the sheet to prevent it from rebounding from the stop 46.

The support tray 132 forms part of the upper platform 90 of the inverter 24 and extends parallel to the upper run 84 of the conveyor belt 80 which is disposed directly beneath the tray. As the sheet engages the stop surface 46, the printed side 14 of the sheet faces downwardly toward the support tray 132. To prevent smudging of the ink on the printed side surface 14 of the sheet, a plurality of parallel ribs or ridges 139 (FIG. 6) are formed in the support tray 132. The ribs 139 engage a relatively long narrow area on the printed major side 14 of the sheet and prevent widespread contact with the sheet surface.

After the side edge 42 of the sheet has been moved into engagement with stop surface 46, the pusher 56 is moved along the tray 132 toward the printing unit 50. The pusher 56 is mounted on a carriage 142 which is disposed on the platform 90 beneath the support tray 132. The carriage 142 and pusher member 56 are moved along a horizontal path extending parallel to the longitudinal central axis of the upper run 84 of the conveyor belt 80.

Upon movement of the carriage 142 and pusher 56 toward the printing unit 50, an upright face surface 146 of the pusher 56 engages the foot edge 18 of the sheet and pushes the sheet into a nip formed between the belts 58 of conveyor 54 at pulley 148, and a feed roller 150 (see FIGS. 1 and 2).

The conveyor belts 58 feed the sheet 12 into the printing unit 50 with the head edge 16 of the sheet leading and the blank side 44 of the sheet facing upwardly. As the sheet passes through a printing nip 154, a master 156 (FIG. 1) on a plate or master cylinder 158 prints on the upper side 44 of the sheet. As the sheet passes through the printing nip 154, the previously printed side 14 of the sheet is supported by an impression cylinder 160.

Figure 6:
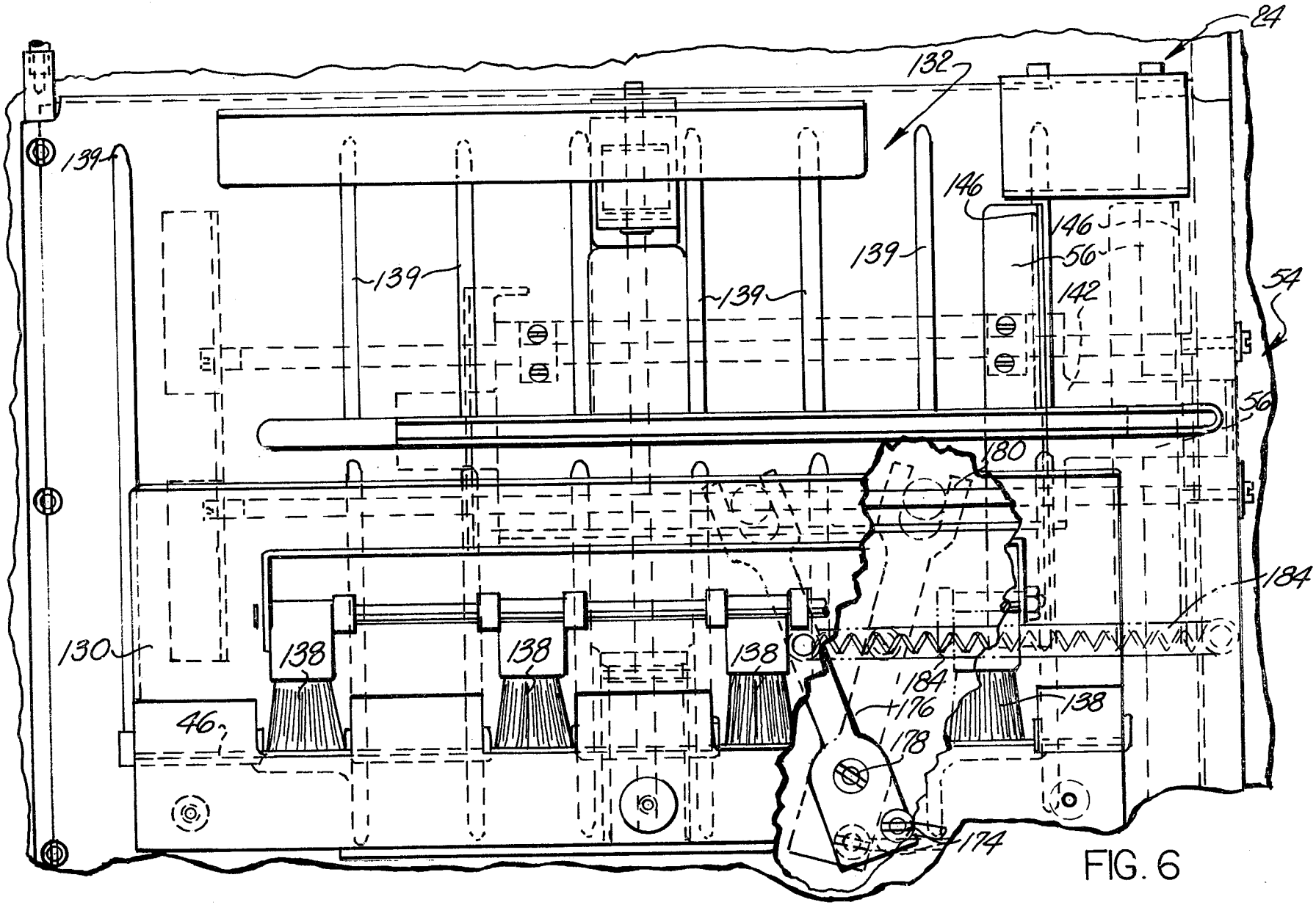
FIG. 6 is a fragmentary plan view, with parts broken away, taken generally on line 6—6 of FIG. 2, illustrating a pusher member and a portion of the linkage activated by the other of the cams in FIG. 3.

Although the pusher 56 (FIG. 6) could be driven in many different ways to effect movement of a sheet from the inverter 24 toward the printing unit 50, the pusher member 56 is advantageously driven in timed relationship with the operation of the printing units 10 and 50 by a cam 164 (see FIG. 3) which is connected with the shaft 96 and rotates with the cam 94. The cam 164 pivots the cam follower lever 166 to effect movement of a horizontal link 168 connected with a link 170 (FIG. 2) which is pivotally mounted on a base frame at 172. Pivotal movement of the link 170 moves a link 174 to cause a lever arm 176 (FIG. 6) to pivot about vertical axis 178 (FIG. 6). The lever arm 176 has a pin and slot connection 180 with the pusher carriage 142 so that pivotal movement of the arm 176 in a counterclockwise direction (as viewed in FIG. 6) about the pivot 178 under the influence of the cam 164 causes the pusher 56 to push against the foot edge 18 of the sheet 12 to move the sheet toward the printing unit 50. The pusher 56 is moved against a return spring 184. When the pusher 56 reaches the end of its stroke, the cam 164 allows the follower lever 166 to pivot in a counterclockwise direction (as viewed in FIG. 3) and the spring 184 acts to return the carriage 142 and the pusher 56 to the initial position shown in solid lines in FIG. 6.

Figure 4:
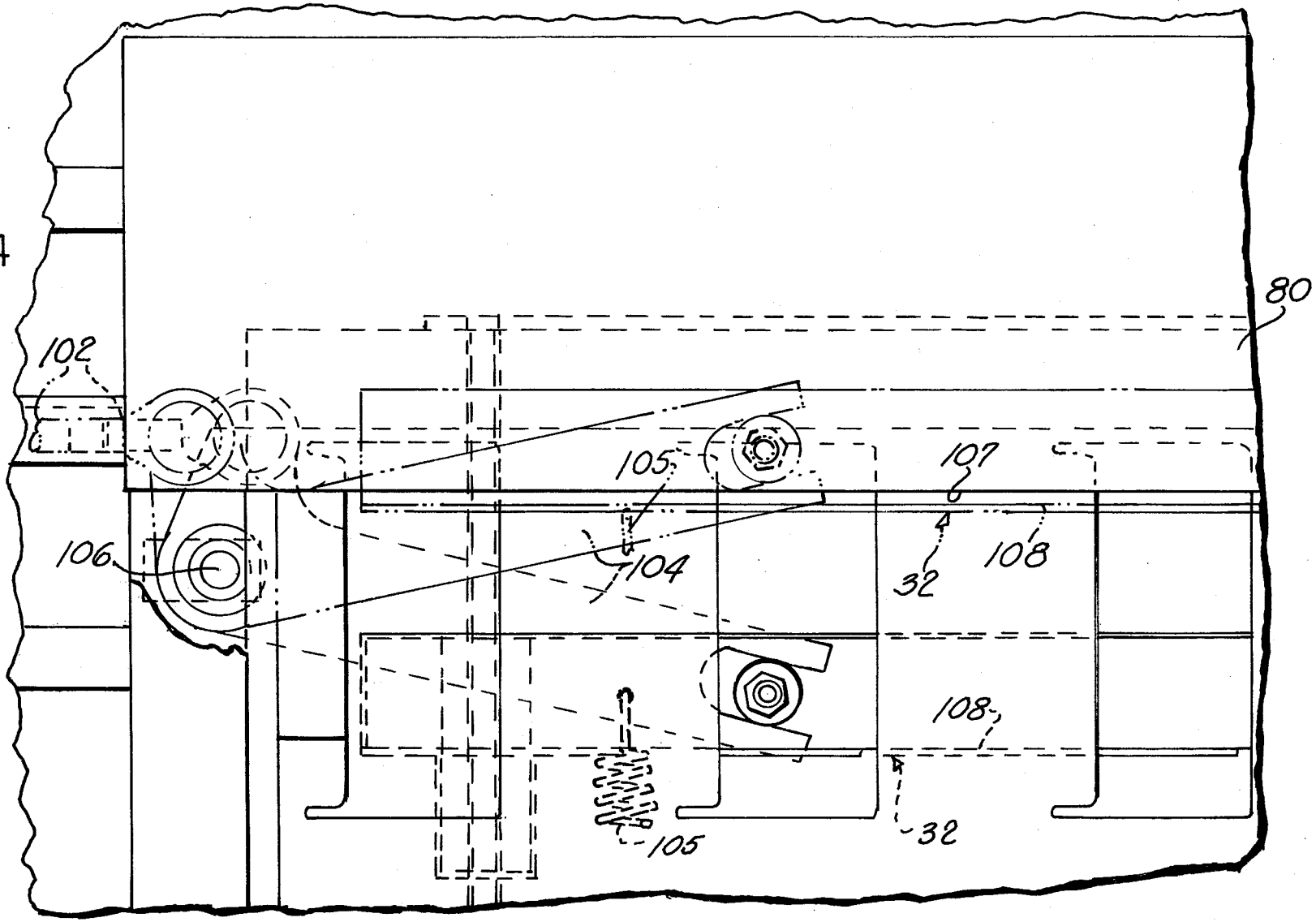
FIG. 4 is a fragmentary plan view taken on line 4—4 of FIG. 2, illustrating a pusher member and linkage activated by one of the cams of FIG. 3.

In order to make the Figures consistent, FIG. 6 shows the parts in positions corresponding contemporaneously to the positions in FIGS. 3 and 4; i.e., with the pusher 32 retracted and the pusher 56 substantially extended. Of course, by the time the cam 94 has moved to a location causing extension of the pusher 32 to start turnover action of the sheet, cam 164 will have moved counterclockwise to a position perhaps 80° from that shown, so that at this time the pusher 56 will be substantially in its dotted or retracted position in FIG. 6, ready to receive the sheet as it approaches from the turnover mechanism 39. Projection of the sheet by means of pusher 56 will then occur when the lobe of cam 164 activates its follower 166 on the succeeding cycle.

In accordance with a feature of the present invention, the turnover mechanism 39 may be bypassed so that a sheet passing through the printing unit 10 is conducted directly to the printing unit 50 without being turned over. At this time, the printing unit 50 would either be in a thrown-off or ineffective condition in which the sheet would pass through the printing unit 50 without the occurrence of a printing operation, or would be arranged to make an impression of a different character (e.g., a different color) on the face of the sheet already printed.

To move the conveyor 22 to a bypass condition, a handle 190 (see FIG. 2) is rotated in a clockwise direction about a pivot connection 192. This causes a main lever 194 to actuate a link 196 to move one end of a frame member 198 carrying the conveyor 80 upwardly from the position shown in FIG. 2. By virtue of the link 199, the upper platform 90 is also pivoted upwardly to the dotted line position to make room for frame 198. This results in the upper run of the conveyor belt 80 being disposed with its left-hand end in line with the nip 148, 150, above the upper edge of the stop 28 and above the path of the pusher 32, both of which are mounted on the base frame. Therefore, the conveyor 80 is operable to feed a sheet directly into the feed nip between the rollers 148 and 150 without inverting the sheet.

In view of the foregoing description it can be seen that the present invention provides an apparatus and method which inverts a sheet 12 between a pair of work units or printing heads 10 and 50 in such a manner that the same edge 16 of the sheet leads as it passes through the two units. After a sheet 12 has been acted on by the first work unit 10 with the side 14 facing up, with a head edge 16 leading, a first conveyor 80 between the work units 10 and 50 receives the sheet 12 with the head edge 16 of the sheet leading. When the sheet 12 has been moved by the first conveyor 80 to a first ready position, the head edge 16 of the sheet engages a stop 28. A pusher 32 then engages a side edge 34 of the sheet and moves the sheet into the turnover mechanism 39 with the opposite side edge 42 of the sheet leading.

The turnover mechanism moves the sheet 12 along a generally U-shaped path from an orientation in which the printed side 14 of the sheet faces upwardly to an orientation in which the blank side 44 of the sheet faces upwardly. At the end of this generally U-shaped path, the leading side edge 42 of the sheet 12 engages a stop 46 to register the sheet relative to the second work unit 50 at a second ready position. A pusher 56 then introduces the sheet along a substantial extension of its original path to a conveyor 54 which is effective to move the sheet into the second work unit 50 with the head edge 16 of the sheet leading and the side 44 of the sheet facing upwardly.

Having described one specific preferred embodiment of the invention, the following is claimed:

1. An apparatus for sequentially working on flexible sheets which comprises:

first work means for working on a sheet as it moves therethrough in a first path with one side facing upwardly and a first edge leading;

second work means spaced from said first work means for subsequently working on the sheet with the other side of the sheet facing upwardly as it moves therethrough in a second path which is a substantial extension of said first path; and sheet inverting means between said first and second work means for receiving said sheet from said first work means along said first path, for moving said sheet along a U-shaped turnover path substantially normal to said first and second paths with a second edge normal to said first edge leading, and for thereafter feeding the sheet along said second path to said second work means with said second side facing upwardly and said first edge leading.

2. An apparatus for sequentially printing on first and second sides of a flexible sheet having first and second parallel edges interconnected by third and fourth parallel edges perpendicular to said first and second edges, said apparatus comprising:

first printing means for printing on the first side of the sheet as the sheet moves therethrough in a first path with its first side facing upwardly and with the first edge of the sheet leading;

second printing means spaced from said first printing means for printing on the second side of the sheet as the sheet moves therethrough in a second path which is a substantial extension of the first path with the second side of the sheet facing upwardly;

inverting means between said first and second printing means for accepting a sheet from said first printing means along said first path, for changing the orientation of the sheet from an orientation in which the first side of the sheet faces upwardly to an orientation in which the second side of the sheet faces upwardly by moving the sheet along a U-shaped turnover path extending transversely of said first and second paths, and for feeding the sheet into said second path to said second printing means with said second side facing upwardly and said first edge leading.

3. An apparatus as set forth in claim 2 wherein said means between said first and second printing means includes pusher means for engaging the fourth edge of the sheet and pushing the sheet at least part of the way along the path which extends transversely to the direction of movement of the sheet through said first printing means.

4. An apparatus as set forth in claim 2 wherein said means between said first and second printing means includes stop means for engaging the third edge of the sheet at the end of the path which extends transversely of said first and second paths to stop the sheet with the third edge of the sheet in a predetermined position relative to said second printing means.

5. An apparatus as set forth in claim 2 wherein said means between said first and second printing means includes first stop means for engaging the first edge portion of the sheet during movement of the sheet away from said first printing means with the first side of the sheet facing upwardly, first surface means for engaging the second side of the sheet to support the sheet as its first edge approaches engagement with said first stop means, and second surface means at the end of the path extending transversely to the direction of movement of sheet through said first printing means for engaging the first side of the sheet with the second side of the sheet facing upwardly, said second surface means extending parallel to and spaced apart from said first surface means.

6. An apparatus as set fourth in claim 5 further including second stop means for engaging the third edge of the sheet when the sheet is disposed on said second surface means.

7. An apparatus as set forth in claim 2 wherein said means between said first and second printing means includes first conveyor means for moving the sheet away from said first printing means along a first path portion with the first side of the sheet facing upwardly, and second conveyor means for moving the sheet toward said second printing means along a second path portion with the second side of the sheet facing upwardly, said U-shaped turnover path having an initial portion at one end of said first conveyor means and a terminal portion at the beginning of said second conveyor means, said initial and terminal portions of said U-shaped turnover path being disposed substantially in vertical alignment with each other.

8. An apparatus as set forth in claim 2 wherein said path extending transversely of said first and second paths extends perpendicular to the direction of movement of the sheet through said first printing means and has beginning and end portions disposed in an overlapping relationship.

9. An apparatus as set forth in claim 2 wherein said means between said first and second printing means includes first stop means for engaging the first edge of the sheet during movement of the sheet away from said first printing means toward said second printing means to stop the sheet in a first position, first pusher means for engaging the fourth edge of the sheet when the sheet is in said first position and for pushing the sheet along an initial portion of the path which extends transversely to the path of movement of the sheet through said first printing means, second stop means for engaging the third edge of the sheet during movement of the sheet along the path which extends transversely to the path of movement of the sheet through said first printing means to stop the sheet in a second position, and second pusher means for engaging the second edge of the sheet when the sheet is in said second position and for pushing the sheet away from said second position toward said second printing means.

10. An apparatus as set forth in claim 9 wherein said means between said first and second printing means further includes a longitudinally extending conveyor belt which engages said second side of the sheet to move the sheet to said first position and to support the sheet in said first position, said first pusher means being movable transversely of the longitudinal axis of said conveyor belt to push the sheet along the initial portion of the path which extends transversely to the path of movement of the sheet through said first printing means.

11. An apparatus as set forth in claim 10 wherein said means between said first and second printing means further includes a stationary support tray which engages the first side of the sheet when the sheet is in said second position.

12. An apparatus as set forth in claim 11 wherein said support tray includes a plurality of ribs to support the sheet by engagement of said ribs with relatively long narrow portions of the first side of the sheet to prevent smudging of the printing on the first side of the sheet.

13. An apparatus as set forth in claim 7 wherein at least a portion of said first conveyor means is movable between a first position in which a sheet is movable from said first conveyor means to said sheet turnover path and a second position in which said first conveyor means is effective to bypass said sheet turnover path and effect movement of the sheet to said second conveyor means with the first side of the sheet facing upwardly.

14. Apparatus for moving a sheet along a primary path and turning the sheet over while maintaining the first edge of the sheet in leading position which comprises:

receiving means for receiving a sheet moving along the path, with said first edge leading;

turnover means for moving the sheet transversely of the primary path through a U-shaped path with a second edge normal to said first edge leading, to turn the sheet over; and means for moving the turned over sheet in a substantial continuation of said primary path with said first edge leading.

15. Apparatus as set forth in claim 14 in which the turnover means includes conveyor belts and a U-shaped guide surface to convey the sheet to a turned over position.

16. Apparatus as set forth in claim 15 in which vacuum means are provided for maintaining driving contact between the conveyor belts and the sheet as the sheet progresses through the turnover process.

17. Apparatus as set forth in claim 16 in which there is provided a stop associated with said receiving means and a pusher operating in a direction normal to said primary path for introducing the sheet to the turnover means.

18. Apparatus as set forth in claim 17 in which the means for moving the turned over sheet in a continuation of the primary path includes a stop for arresting the sheet in the proper location as it leaves the turnover means, and a pusher operating in the direction of the primary path for introducing the sheet into the continuation thereof.

19. Apparatus as set forth in claim 16 in which the turnover device comprises a first belt and vacuum system for moving the sheet onto and across the U-shaped guide and a second belt and vacuum system for moving the turned over sheet away from the U-shaped guide and returning it to a position in line with the primary path.

20. Apparatus as set forth in claim 14 in which the means for receiving the sheet comprises a shiftable conveyor movable alternatively between a normal position in which it cooperates with turnover means, and a second position in which it bypasses the turnover means and conveys the sheet continuously along the primary path.

21. A method of sequentially printing on opposite sides of material comprising:

continuously feeding sheets of material in sequence along a first printing path through a first printing head with a first side facing upwardly and a first edge leading, and printing on said first side;

as each sheet issues from said first printing head, mechanically moving said sheet transversely of said path with a second edge, normal to said first edge leading, and thence through a U-shaped path to turn the sheet over;

and thereafter, as each sheet is turned over, mechanically feeding the thus turned over sheet along a second printing path substantially an extension of said first printing path to a second printing head with its second side facing upwardly and its first edge leading, and printing on said second side of the sheet.

22. A method as set forth in claim 21 in which said step of turning the sheet over includes the steps of engaging the first edge of the sheet with a first stop surface to interrupt movement of the sheet in the direction away from the first printing unit, moving the sheet from the first printing path to the second printing path along said U-shaped path, and engaging the second edge of the sheet with a second stop surface to interrupt movement of the sheet when the sheet is disposed in line with the second path.

23. A method as set forth in claim 22 wherein said step of moving the sheet along the U-shaped path includes the step of pushing against an edge opposite said second edge of the sheet, and wherein said step of moving the sheet along the second path length includes the step of pushing against an edge opposite said first edge of the sheet.

* * * * *